US005383634A

United States Patent [19]

Liao

[11] Patent Number: 5,383,634

[45] Date of Patent: Jan. 24, 1995

[54] COLLAPSIBLE GUITAR STAND

[75] Inventor: Tsun-Chi Liao, Taichung, Taiwan, Prov. of China

[73] Assignee: Hwa Shin Musical Instrument Co., Ltd., Taichung, Taiwan, Prov. of China

[21] Appl. No.: 58,251

[22] Filed: May 10, 1993

[51] Int. Cl.[6] ..... G10D 3/00

[52] U.S. Cl. ..... 248/166; 84/327; 248/168; 248/176

[58] Field of Search ..... 248/165, 166, 168, 434, 248/176, 188; 84/327

[56] References Cited

U.S. PATENT DOCUMENTS

| | | | |
|---|---|---|---|
| 1,612,148 | 12/1926 | Oettinger | 248/166 X |
| 2,896,891 | 7/1959 | Ernst | 248/168 |
| 4,203,242 | 5/1980 | Griffin | 248/168 X |
| 4,402,441 | 9/1983 | Jones et al. | 84/327 X |
| 4,582,282 | 4/1986 | Gracie | 84/327 X |
| 4,609,174 | 9/1986 | Nakatani | 248/168 X |
| 4,943,021 | 7/1990 | Cien et al. | 248/176 X |
| 5,029,796 | 7/1991 | Schoenig | 248/166 X |
| 5,165,634 | 11/1992 | Garbuzov et al. | 248/166 |

*Primary Examiner*—Ramon O. Ramirez
*Assistant Examiner*—Derek J. Berger
*Attorney, Agent, or Firm*—Bacon & Thomas

[57] ABSTRACT

A collapsible guitar stand which includes a top member having two bottom holes spaced by a bottom frame, two front legs pivotably connected to either bottom hole of the top member, a back leg pivotably connected to a longitudinal groove on the bottom frame, and two supporting rods respectively and pivotably connected to oblong holes on the front legs to hold a guitar on the front legs. The guitar stand is collapsed by turning the supporting rods upwards toward the front legs, moving the front legs inward toward each other, and moving the back leg forward toward the front legs.

1 Claim, 4 Drawing Sheets

COLLAPSIBLE GUITAR STAND

BACKGROUND OF THE INVENTION

The present invention relates to a stand for holding a guitar which can be conveniently folded up to minimize its prior storage space when not in use.

To those amateur music instrument players, the guitar is most popularly accepted. When a guitar is not in use, it must be properly supported. A variety of guitar stands have disclosed, and have appeared on the market. However, these conventional guitar stands are commonly not collapsible and inconvenient to carry. When not in use, much storage space is still needed for a conventional guitar stand.

SUMMARY OF THE INVENTION

It is the principal object of the present invention to provide a guitar stand which can be conveniently folded up to reduce its storage space when it is not in use. It is another object of the present invention to provide a collapsible guitar stand which is inexpensive to manufacture and easy to assemble. According to the preferred embodiment of the present invention, the guitar stand has two supporting rods pivotably connected to two front legs thereof, which are connected to a top member supported by a back leg. The supporting rods are turned outwards from the front legs and retained at a respective horizontal position in parallel with each other, to support a guitar on the front legs when the front legs and the back leg are respectively extended outwards relative to one another. The guitar stand is collapsed by turning the supporting rods upwards toward either front leg and then moving the front legs and the back leg toward the center the guitar stand.

DETAILED DESCRIPTION OF THE PREFERRED EMBODIMENT

Figure 1:
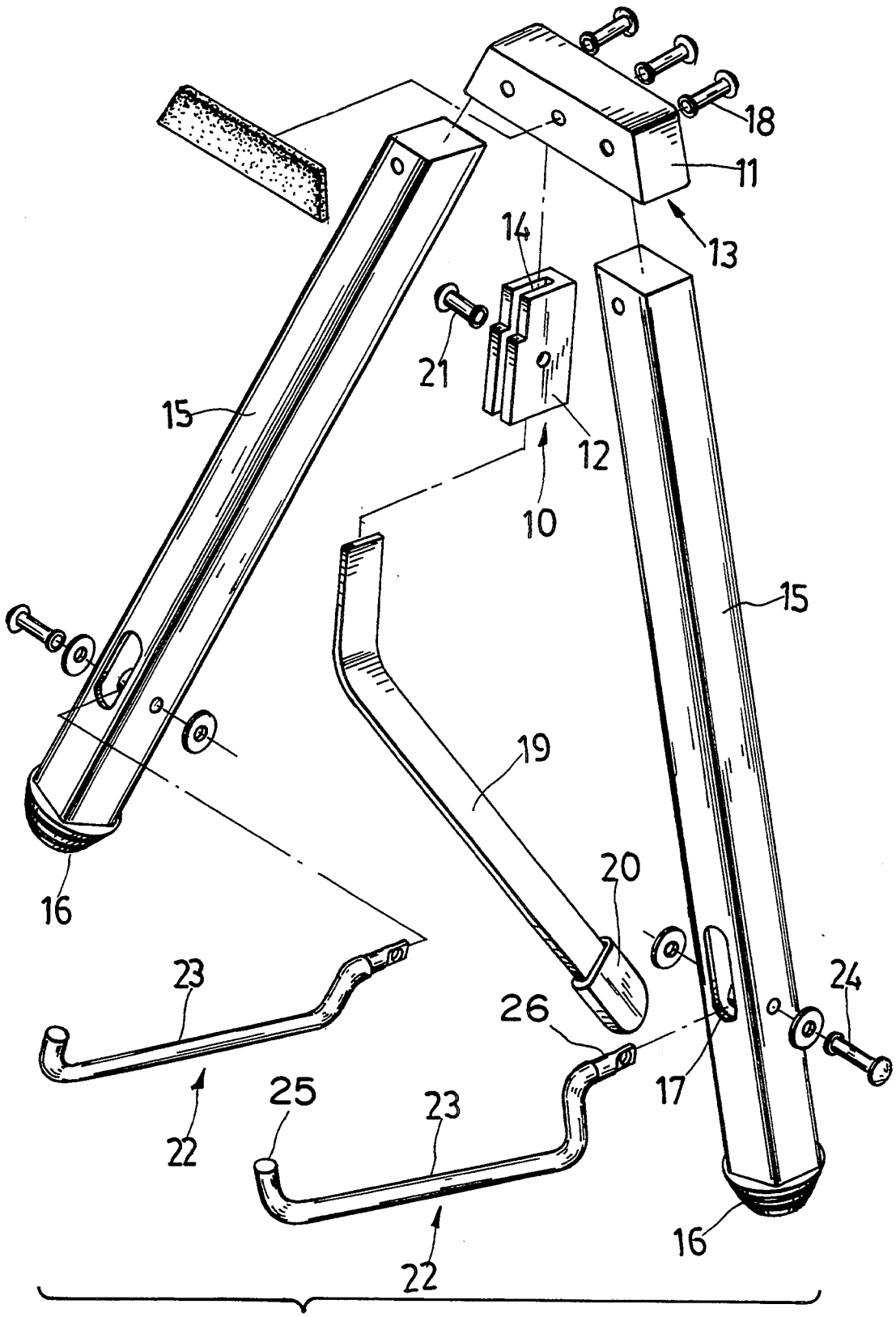
FIG. 1 is a perspective exploded view of a collapsible guitar stand according to the preferred embodiment of the present invention.
Figure 2:
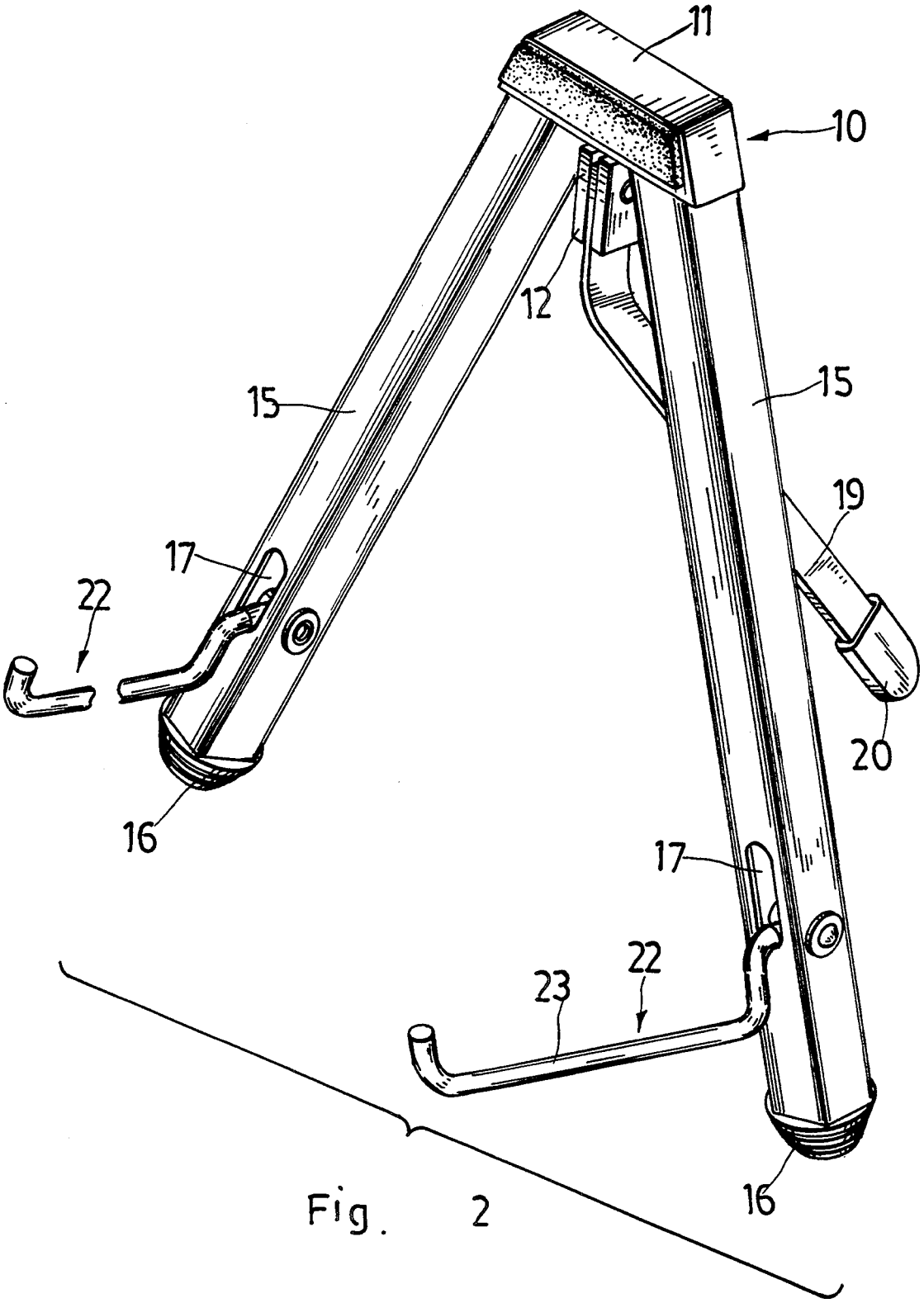
FIG. 2 is a perspective elevational view of the collapsible guitar stand.
Figure 3:
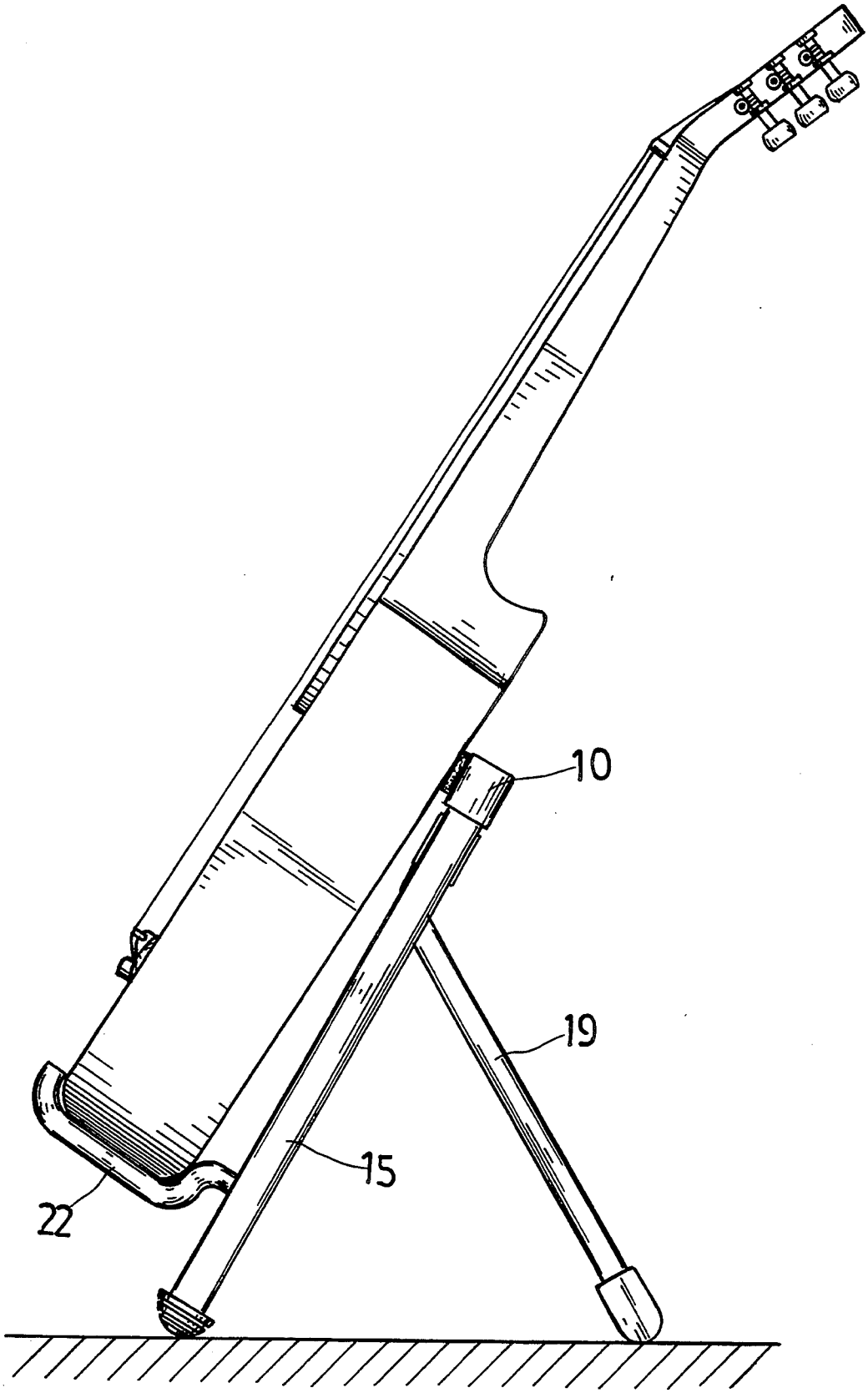
FIG. 3 is a side view of the collapsible guitar stand showing a guitar supported thereon.

Referring to FIGS. 1 and 2, a collapsible guitar stand in accordance with the preferred embodiment of the present invention is generally comprised of a crossbeam assembly 10, two front legs 15, a back leg 19, and two supporting rods 22.

The crossbeam assembly 10 comprises a top member 11, and a bottom frame 12 perpendicularly connected to the top member 11 in the middle at the bottom. The top member 11 has two spaced bottom holes 13, which receive the front legs 15 respectively. The bottom frame 12 has a groove 14 through its length.

The leg 15 is made from a hollow, rectangular bar having a bottom end attached with a foot pad 16, and a top end pivotably fastened to either bottom hole 13 of the top member 11 by a pivot pin 18. When connected to the top member 11, the leg 15 can be oscillated from one end of the top member 11 towards the opposite end thereof within a fixed angle. An oblong opening 17 is made on the leg 15 at a lower elevation spaced from the foot pad 16 for holding a respective supporting rod 22.

The back leg 19 is made from a flat bar having a curved top end pivotably fastened to the groove 14 on the bottom member 12 by a pivot pin 21, and a bottom end coupled with a soft protective covering 20.

The supporting rod 22 is made from a round rod covered with a soft sleeve 23, having a rear end 26 curved sideways at right angles and then curved forwards at right angles, and a front end 25 slightly curved sideways in the same direction. The rear end 26 of the supporting rod 22 is pivotably fastened to either oblong opening 17 at a lower elevation by a pivot pin 24. When connected, the supporting rod 22 is retained at a horizontal position, and can be turned upwards and disposed at a vertical position.

Referring to FIG. 2 again, the two front legs 15 are bilaterally extended outwards, then the back leg 19 is extended backwards to support the front legs 15 via the crossbeam assembly 10, and then the supporting rods 22 are respectively extended outwardly downwards into the respective horizontal positions to hold a guitar on the front legs 15.

Figure 4:
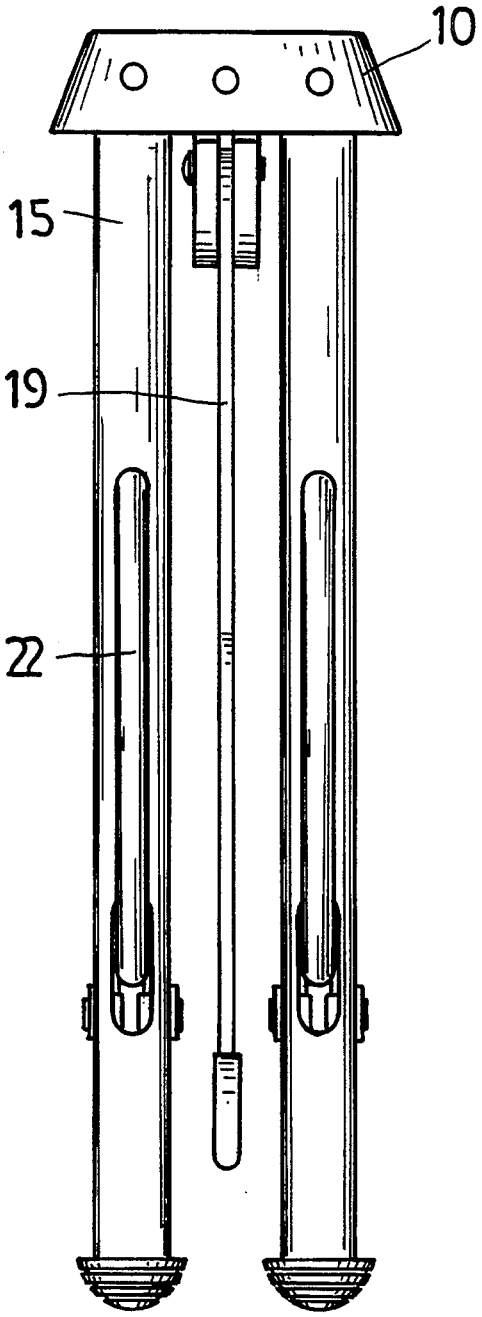
FIG. 4 is a front view of the collapsible guitar stand when collapsed.
Figure 5:
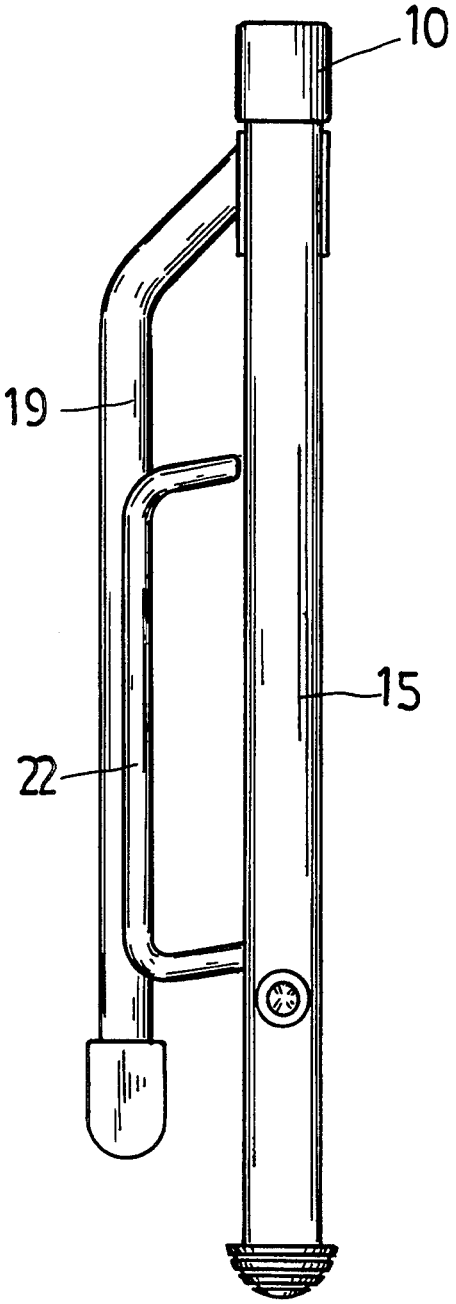
FIG. 5 is a side view of the collapsible guitar stand when collapsed.

Referring to FIGS. 4 and 5, the guitar stand can be collapsed by: moving the front legs 15 towards each other, moving the back leg 19 towards the gap between the front legs 15, and turning the supporting rods 22 upwards to the respective vertical positions closely adjacent and parallel front legs 15.

I claim:

1. A collapsible guitar stand comprising:

a) a crossbeam assembly including a horizontal top member having a hollow bottom portion, and a bottom frame, the bottom frame being connected to the vertical bottom portion of the top member to define a pair of bottom holes therein, the bottom frame having a groove extending along the length thereof;

b) a pair of front legs, each front leg including first and second ends, the first end of each front leg being pivotally secured within a bottom hole for permitting the front legs to be folded together, and each front leg further including a forwardly facing oblong opening formed adjacent the second end;

c) a back leg including a curved top end pivotally secured in the groove of the bottom frame for permitting the back leg to be folded forwardly and disposed between the front legs; and d) a pair of supporting rods, each supporting rod including a first end pivotally secured to the front leg through the oblong opening thereof for permitting the rod to be folded upwardly towards the front leg and be disposed substantially parallel and adjacent thereto.

* * * * *